United States Patent [19]

Jones et al.

[11] 3,973,115

[45] Aug. 3, 1976

[54] VEHICLE LAMP UNIT

[75] Inventors: Kenneth James Jones; Robert Arthur Hargroves, both of West Midlands, England

[73] Assignee: The Lucas Electrical Company Limited, Birmingham, England

[22] Filed: Feb. 26, 1975

[21] Appl. No.: 553,283

[30] Foreign Application Priority Data

Mar. 5, 1974 United Kingdom ..... 9724/74

[52] U.S. Cl. ..... 240/41.35 C; 240/41.1; 240/46.29

[51] Int. Cl.[2] ..... F21V 7/00

[58] Field of Search ..... 240/41.35 C, 41.35 R, 240/41.3, 41.1, 46.03, 46.25, 46.29

[56] References Cited

UNITED STATES PATENTS

| | | | |
|---|---|---|---|
| 1,489,341 | 4/1924 | Boyd et al. | 240/41.1 |
| 1,660,699 | 2/1928 | Wood | 240/46.29 |
| 1,894,876 | 1/1933 | Kuhn | 240/41.1 |
| 1,898,143 | 2/1933 | Schensted | 240/41.1 |
| 1,995,012 | 3/1935 | Rivier | 240/41.1 |
| 2,562,258 | 7/1951 | Bone | 240/46.05 |
| 3,673,421 | 6/1972 | Hicks et al. | 240/46.29 |

*Primary Examiner*—R. L. Moses
*Attorney, Agent, or Firm*—Holman & Stern

[57] ABSTRACT

The vehicle lamp unit comprises a housing having a window therein. Within the housing is an ellipsoidal reflector, and a concave mirror disposed to project light emanating from the reflector through the window. A mask is disposed at the outer focal plane of the reflector and is movable into and out of a masking position by means of a solenoid and connecting linkage. In a preferred arrangement, the reflector is mounted within the housing for pivotal movement about an axis which is inclined with respect to the horizontal.

4 Claims, 2 Drawing Figures

VEHICLE LAMP UNIT

This invention relates to a vehicle lamp unit.

According to the present invention, there is provided a vehicle lamp unit comprising a housing having a window therein, a curved reflector, a bulbholder, a curved mirror, said reflector, bulbholder and mirror being mounted in a housing in such a manner that a light beam emanating from a bulb when mounted in the bulbholder is directed by the reflector to the mirror which reflects the light beam through the window in the housing, a mask mounted in the housing between the reflector and mirror, and means for moving the mask relative to the reflector between a first position in which it masks the light beam to a predetermined extent and a second position in which the extent of masking is decreased.

Preferably, the mask, in its second position, lies clear of the light beam so that no masking operation is performed.

In a convenient embodiment, the mask moving means includes a solenoid having a movable output member which is connected with the mask preferably, the output member is connected with the mask through the intermediary of a linkage.

The above-described arrangement permits a vehicle lamp unit to be operated on main and dipped beams using only a single mirror and a single reflector.

Figure 1:
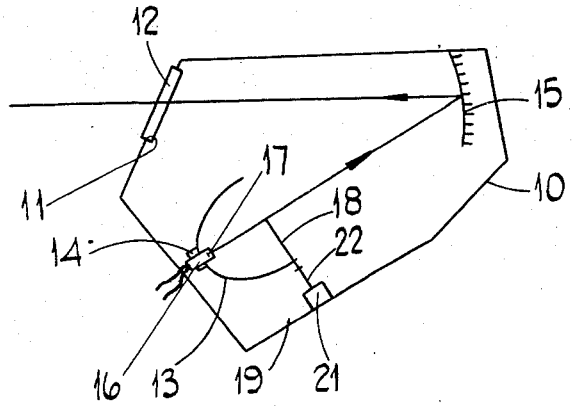
Figure 2:
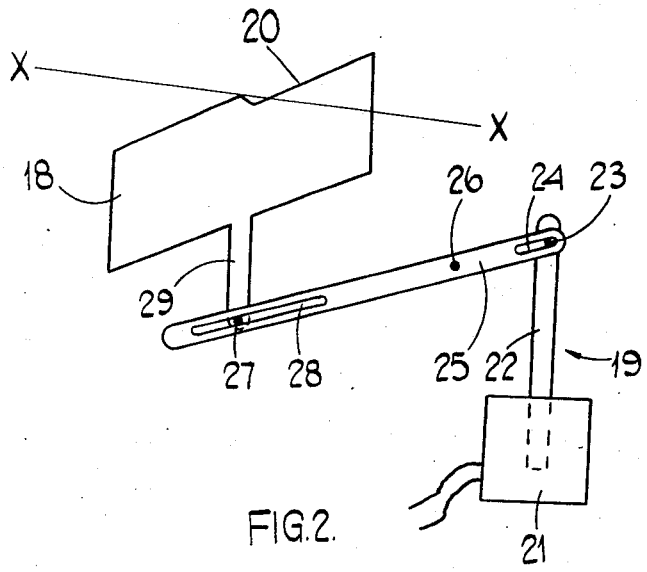

An embodiment of the present invention will now be described by way of example, with reference to the accompanying drawing in which:

FIG. 1 is a schematic elevation of a vehicle lamp unit according to the present invention, and FIG. 2 is a perspective view of a mask and mask moving means forming part of the vehicle lamp unit of FIG. 1.

Referring firstly to FIG. 2, the vehicle lamp unit comprises a housing 10 having a window 11, therein, a transparent lens 12 mounted in the window 11, an ellipsoidal reflector 13, a bulbholder 14, and a concave mirror 15. The ellipsoidal reflector 13, bulbholder 14 and concave mirror 15 are disposed within the housing 10 in such a manner that light emanating from a bulb 16 carried, in use, by the bulbholder 14 is directed as a light beam towards the concave mirror 15 to be reflected thereby. The reflected light beam from the concave mirror 15 passes through the lens 12. A filament 17 of the bulb 16 is mounted in the inner focal plane of the ellipsoidal reflector 13.

The vehicle lamp unit further comprises a planar mask 18 which is mounted to lie in the outer focal plane of the ellipsoidal reflector 13, and mask moving means 19. The mask moving means 19 is arranged to effect planar movement of the mask 18 between a first position in which it lies with an upper edge portion 20 thereof just below the optical axis X of the ellipsoidal reflector 13 (as shown in FIG. 2), and a second position in which it is moved downwardly from the first position as viewed in FIG. 2. In its first position, the mask 18 masks the light beam passing between ellipsoidal reflector 13 and concave mirror 15 to a predetermined extent and the position of the mask 18 is such that it provides a sharp cut-off of the top of the beam projected through the lens 12. In its second position, the mask 18 is moved so that the light beam passing between ellipsoidal reflector 13 and concave mirror 15 is completely unobstructed. Thus, in the first position of the mask 18, the vehicle lamp unit projects what is commonly known in road vehicle terminology as a "dipped beam", whilst in the second position of the mask 18, the vehicle lamp unit projects what is commonly known as a "main" or "full" beam.

The mask moving means 19 comprises a solenoid 21 having an output rod 22 which carries a pivot 23 at its free end. The pivot 23 engages in an elongated slot 24 in a link 25 pivoted at 26 to the housing 10. At the opposite end of link 25 to slot 24, a pin 27 engages in a further elongate slot 28 in the link 25. An arm 29 attached to, and projecting downwardly from, the mask 18 carries the pin 27. The output rod 22 is biased by means of spring (not shown) upwardly as viewed in FIG. 2 so that when the solenoid 21 is not energised, the mask 18 is in its second position. When the solenoid 21 is energized, the rod 22 is drawn downwardly as viewed in FIG. 2 to the position illustrated therein. Such downward movement of the rod 22 effects clockwise pivotal movement of link 25 about pivot 26 due to the engagement of pin 23 in slot 24. As a result of such movement of the link 25, the arm 29 and thus the mask 18 is caused to move upwardly as viewed in FIG. 2 to its first position, as illustrated.

The above-described vehicle lamp unit can thus be easily converted from "dip" beam to "full" beam by opening a switch (not shown) in a supply circuit to solenoid 21.

In a modification, the reflector 13 is mounted for tilting movement about an axis which is inclined to the horizontal. Means are provided for effecting tilting movement of the reflector 13 about said axis so as to raise the beam projected by the lamp unit and displace it in one direction in a horizontal plane when the mask 18 is moved into its second position, and so as to lower the beam projected by the lamp unit and displace it in the opposite direction in the horizontal plane when the mask 18 is moved into its first position.

The reflector tilting means may also operate to effect tilting of the mask 18 simultaneously with the reflector 13. The reflector tilting means may be operated by the solenoid 21 or as a result of operation of the solenoid 21.

Such reflector tilting means is provided in order to project the light beam in the optimum direction under dipped beam and full beam conditions.

We claim:

1. A vehicle lamp unit comprising a housing having a window therein, a curved reflector, a bulbholder, a curved mirror, said reflector, bulbholder and mirror being mounted in said housing in such a manner that a light beam emanating from a bulb when mounted in said bulbholder is directed by said reflector to said mirror which reflects the light beam through said window in said housing, a mask mounted in said housing between said reflector and said mirror, means for moving said mask relative to said reflector between a first position in which it masks the light beam to a predetermined extent and a second position in which the extent of masking is decreased, and means mounting said reflector for tilting movement relative to said housing about an axis which is inclined with respect to the horizontal.

2. The vehicle lamp according to claim 1, wherein said mask in its second position, lies clear of the light beams so that no masking operation is performed.

3. The vehicle lamp unit according to claim 1, wherein said mask moving means includes a solenoid having a movable output member which is connected with said mask.

4. The vehicle lamp unit according to claim 3, wherein said output member is connected with said mask through the intermediary of a linkage.

* * * * *